United States Patent [19]

Scott

[11] 4,287,722

[45] Sep. 8, 1981

[54] COMBINATION HEAT RECLAIM AND AIR CONDITIONING COIL SYSTEM

[76] Inventor: Douglas C. Scott, 502 Madrona, Twin Falls, Id. 83301

[21] Appl. No.: 47,273

[22] Filed: Jun. 11, 1979

[51] Int. Cl.[3] ..... F25B 27/02

[52] U.S. Cl. ..... 62/200; 62/238.6

[58] Field of Search ..... 62/199, 200, 238 E, 62/324 D, 196 A

[56] References Cited

U.S. PATENT DOCUMENTS

| | | | |
|---|---|---|---|
| 2,755,637 | 7/1956 | Schordine | 62/199 |
| 2,961,844 | 11/1960 | McGrath | 62/199 X |
| 4,193,270 | 3/1980 | Scott | 62/196 A X |

*Primary Examiner*—William E. Wayner

[57] ABSTRACT

A combination heat reclaim and air conditioning coil for use in a refrigeration system having standard compressor means, a compressor discharge header connected to the discharge of the compressor means, first condensing means, a condenser supply line operatively connecting said compressor discharge header to said first condenser means, evaporator means, evaporator supply means for operatively connecting said first condenser means to the evaporator means, and a compressor suction header connecting the evaporator means to the suction of the compressor means for receiving the discharge of the evaporator means, wherein said combined heat reclaim and air conditioning coil is selectively connected to the compressor discharge header for condensing refrigerant gas or to the evaporator supply means for service as an air conditioning coil.

22 Claims, 3 Drawing Figures

CP
CP
CK
CK
CK
CK
CK
CK
REG
REG
P
P
P

COMBINATION HEAT RECLAIM AND AIR CONDITIONING COIL SYSTEM

FIELD OF INVENTION

This invention relates to a means for using one heat transfer coil unit for two distinctly separate functions in a refrigeration system. In particular, it is the use of a single coil unit, contained within an air handler system used for maintaining a controlled temperature inside of a building, as both an air conditioning coil for cooling the building, and as a condensing coil for reclaiming heat when heat is required in the building. The invention is particularly useful in applications where space is at a premium and capital investment costs must be held to a minimum, since this invention reduces the size and cost of the air handler by eliminating a double set of single purpose coils, one for heat reclaiming and the other for air conditioning.

DESCRIPTION OF PRIOR ART

Traditionally the refrigeration systems installed in grocery and convenience food stores have been energy wasteful. The typical refrigeration system has utilized one or more outside air condensers, usually mounted on the roof or at the rear of the building, to dissipate heat in the condensing phase of the standard refrigeration cycle. This heat is utterly wasted.

In today's world of ever increasing energy costs, this loss can be very significant. The refrigeration systems for today's modern supermarkets can easily extract hundreds of thousands of BTU's of heat from the numerous display cases, cold storage rooms and coolers each day, even in winter. During cold winter months a wasteful engergy cycle develops. The store must be heated to a comfortable temperature for customers, and this heat warms the refrigerated display cases and coolers. The heat entering the cases and coolers is extracted by the refrigeration system and exhausted to the atmosphere.

Over the past few years the cost of replacing the lost heat in larger refrigeration applications has been significant enough to justify the installation of heat reclaiming systems. Typically, the heat reclaim system is no more than a second condenser connected to the air handling system of the building in such a manner as to utilize the inside atmosphere of the building as a heat sink for the condenser. Usually, these second condensing units, called heat reclaim condensers, are installed in series with the outside atmosphere condenser so that full condensing capacity can be achieved during periods of relatively low heating demands.

During the summer months there is a need to air condition the building and the heat reclaim condenser is isolated from the system and all of the refrigeration systems condensing requirements are met through the use of the outside atmosphere condenser. The installation of this second heat reclaim condenser, and the necessary duct work fans and other air handling equipment, has always been expensive, and, of course its costs could not be justified until the energy cost savings exceeded the costs of installation.

Older supermarket heating and cooling systems typically do not have heat reclaiming systems. For those that do, combination heat reclaim and air conditioning air handlers have been developed. Typical is the system disclosed in Quick, U.S. Pat. No. 3,151,469. In combination air handling systems such as that disclosed by Quick, Pat. No. 3,151,469, there are usually two separate coil systems. The first is a condensing coil for heat reclaim and the second is the usual air conditioning coil.

While in the larger applications, such as in a modern supermarket, the cost of this extra air handling equipment may not be significant in relation to the amount of heat saved, the increased costs of air handling equipment in a smaller application, such as in a convenience store may be too high to be justified in terms of costs of heat saved. As a result heat reclaim condensors are not in common use in convenience food stores.

OBJECTS OF INVENTION

Accordingly, it is an object of this invention to produce a combination heat reclaim and air conditioning unit for smaller applications such as convenience food stores that is economically justifiable in terms of both costs of purchase and operation. Additionally, it is an object of this invention to produce an air handler which contains a combination heat reclaim coil and air conditioning coil which minimizes pressure drop across the coil, thereby reducing fan sizing requirements, weight of the air handler unit and costs of manufacture.

Finally, it is an object of this invention to develop a air handler which contains only one coil serving two functions, the first as a heat reclaim condensing coil, and the second as an air conditioning coil, thereby lowering manufacturing and installation costs.

SUMMARY OF THE INVENTION

These objects are achieved through the use of one coil which serves two functions depending upon whether the temperature control system is calling for heating or cooling of the building.

This invention utilizes a standard refrigeration cycle in which the compressor discharges the compressed refrigerant gas through its discharge header to the outside atmosphere condenser. In the condenser the compressed gas is condensed to a liquid and collected in a receiver. From the receiver the condensed, high pressure, refrigerant is piped to the various thermal expansion valves controlling the evaporators. Once the compressed refrigerant passes through the thermal expansion valve and evaporator, with the resulting depressurization and evaporation of the refrigerant, it is returned to the compressor via the compressor suction header to begin the cycle again.

A combination heat reclaim and air conditioning coil is installed in such a manner as it can be used for both heat reclaiming and air conditioning.

In the heat reclaiming mode of operation the combination coil is plumbed in series with the outside atmosphere condenser. This is accomplished through the use of a three way heat reclaim valve which diverts compressed gas refrigerant flow from its normal direct piping to the outside atmosphere condenser, through the combination heat reclaim and air conditioning coil and then to the outside condenser.

In the air conditioning mode of operation the combination coil is isolated from the high pressure side of the refrigeration cycle and connected to the low pressure side of the refrigeration system for service as an air conditioning evaporator. The combination coil is connected in parallel with the other evaporators, drawing its supply of compressed liquid refrigerant from the common receiver, and discharging its low pressure gaseous refrigerant to the compressor suction header.

This is accomplished in the instant invention by cross connecting the supply line of the typical heat reclaim condenser coil to the high pressure liquid refrigerant supply header being supplied from the outside atmosphere condenser and cross connecting the discharge of the heat reclaim condensing coil to the compressor suction header. Both of these cross connects are controlled by means of valves which are closed when the coil is to be used for heat reclaiming and opened when the combination coil is to be used as a air conditioning coil.

These two cross connect valves, called the air conditioning compressor suction and the air conditioning, liquid supply line valves, respectively, are controlled by solenoids. Also, the three way heat reclaim valve is controlled by a solenoid.

Finally, a purge system, controlled by a solenoid operated purge valve is installed. The purpose of the purge system is to insure that there remains no liquid refrigerant condensate left in the combination heat reclaim and air conditioing coil after use of that coil for heat reclaim and before use of the coil as a air conditioning coil. The reason is to prevent liquid refrigerant from entering the compressor suction header and possibly damaging the compressor during the changeover from heat reclaim to air conditioning.

The solenoid operated purge valve is normally closed and will only energize open to drain liquid condensate to a lower pressure portion of the system when the coil is not being used for either heat reclaiming or air conditioning.

BRIEF DESCRIPTION OF THE DRAWINGS

In the drawings accompanying this application.

DETAILED DESCRIPTION OF PREFERRED EMBODIMENTS

Figure 1:
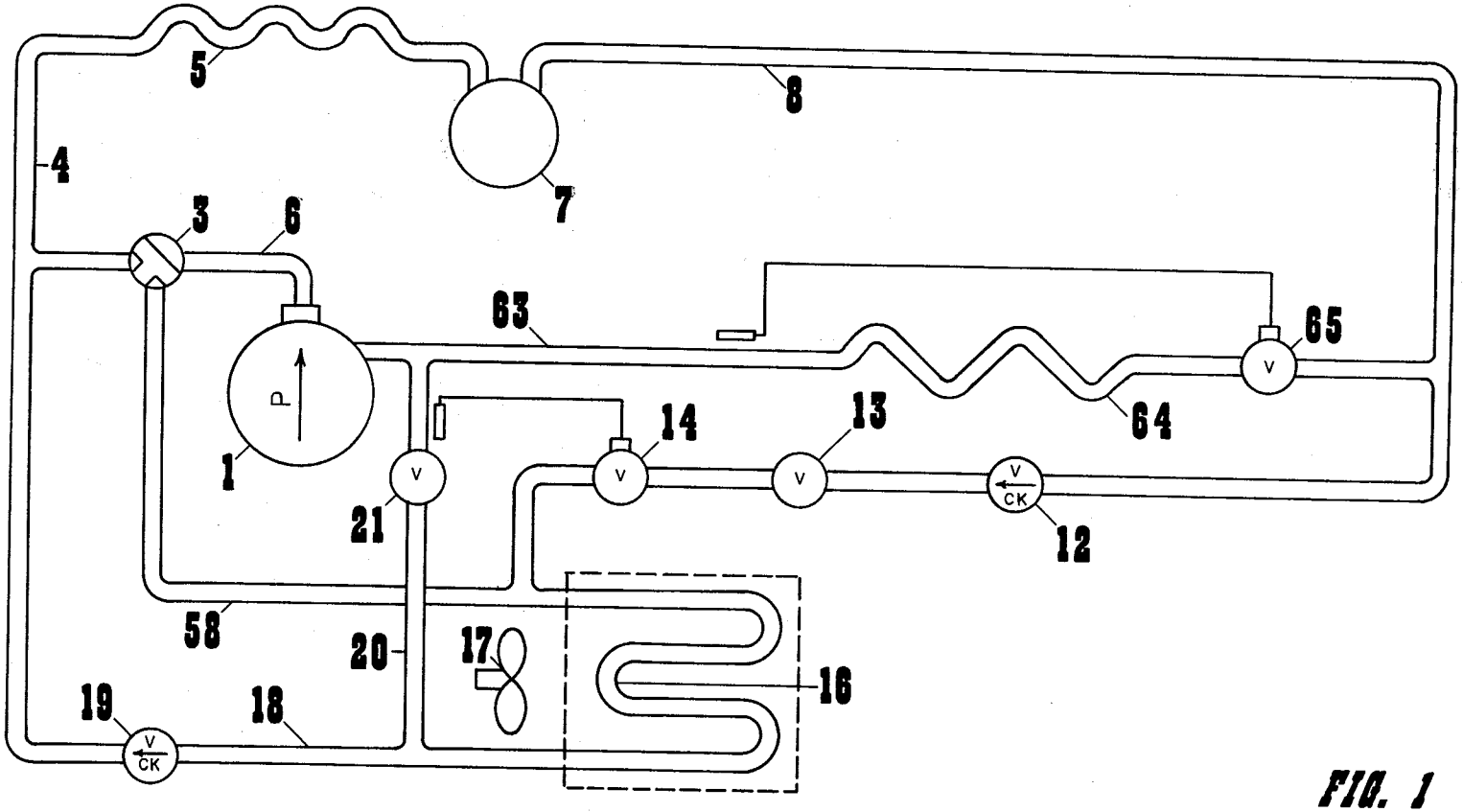
FIG. 1 is a schematic representation of a single compressor refrigeration system.

Referring now to FIG. 1 which is a schematic representation of a single compressor refrigeration system which shows to best advantage the features of this invention, compressor 1 is connected through its compressor discharge header 6 to heat reclaim valve 3. In this embodiment the heat reclaim valve 3 is a solenoid operated valve which, when de-energized is positioned to direct the hot compressed gas discharge of compressor 1 through the condenser supply line 4 directly to the outside condenser 5 and can be energized to direct compressed gas through heat reclaim supply header 58 to the combination heat reclaim and air conditioning coil 16 when it is desirable to reclaim the heat from the refrigeration system.

When the combination coil is not being used for heat reclaiming, the hot compressed gas refrigerant from the compressor discharge header 6 passes through heat reclaim valve 3 directly to condensor supply line 4 and is condensed in outside condenser 5 and transported to receiver 7. Evaporator supply header 8, drawing condensed compressed refrigerant from receiver 7, supplies evaporator 64 through thermal expansion valve 65. The normal refrigeration cycle is completed with the hot low pressure gas refrigerant discharging from evaporator 64 flowing through compressor suction header 63 back to compressor 1.

When heat reclaim is desired, heat reclaim valve 3 is positioned to direct the hot compressed gas refrigerant from compressor discharge header 6 into heat reclaim supply header 58 to the combination heat reclaim-air conditioning coil 16. The discharge from the combination heat reclaim and air conditioning coil 16 passes into the heat reclaim discharge header 18 through heat reclaim discharge header check valve 19 back into condenser supply line 4. Fan 17 moves the inside air past the coil of the combination heat reclaim and air conditioning coil to remove the heat for subsequent distribution inside the building. In effect the combination heat reclaim and air conditioning coil 16 is placed in series with outside condenser 5.

In the heat reclaiming mode of operation, flow of condensed compressed refrigerant from the outlet of coil 16 through the air conditioning compressor suction line 20 to the compressor suction 63 is prevented by the solenoid operated air conditioning compressor suction valve 21. Similarly flow of hot compressed refrigerant gas from heat reclaim supply header 58 through air conditioning liquid line supply header 15 to the evaporator supply header 8 is prevented by the solenoid operated air conditioning liquid supply line valve 13 and by air conditioning liquid line check valve 12.

Figure 2:
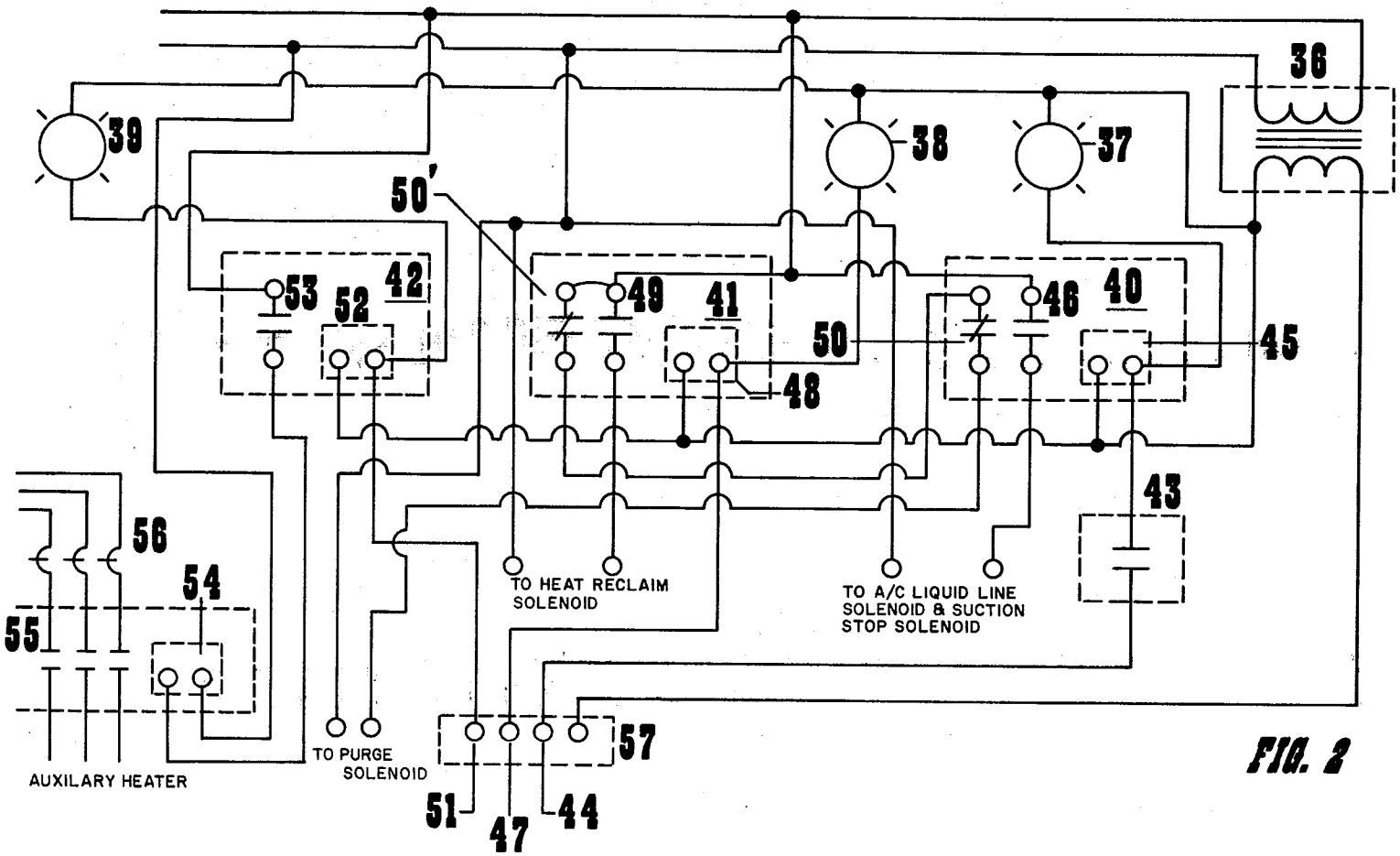
FIG. 2 is a schematic representation of an electrical control system for controlling the operation of the combination coil control valves.

When the control system, such as the one discribed in FIG. 2, calls for use of the combination heat reclaim and air conditioning coil for air conditioning, the solenoid operated air conditioning compressor suction valve 21 and solenoid operated air conditioning liquid line supply valve 13 are both opened and the heat reclaim valve 3 is positioned to transfer compressed refrigerant gas directly to condenser supply line 4. When this occurs the liquid, high pressure refrigerant is supplied through the air conditioning liquid supply line header 15 and the air conditioning thermal expansion valve 14 to the combination heat reclaim and air conditioning coil 16. The hot gas discharge of the combination heat reclaim and air conditioning coil is then discharged through the heat reclaim discharge header 18 to the air conditioning compressor suction line 20, past the now open air conditioning compressor suction valve 21 to the compressor suction header 63.

The combination heat reclaim and air conditioning coil is isolated from the high pressure condensing system through heat reclaim valve 3 which is positioned to direct hot compressed gas refrigerant from the compressor discharge header 6 directly to the condenser supply line 4, with back flow through heat reclaim discharge header 18 being prevented by heat reclaim discharge header check valve 19.

Figure 3:
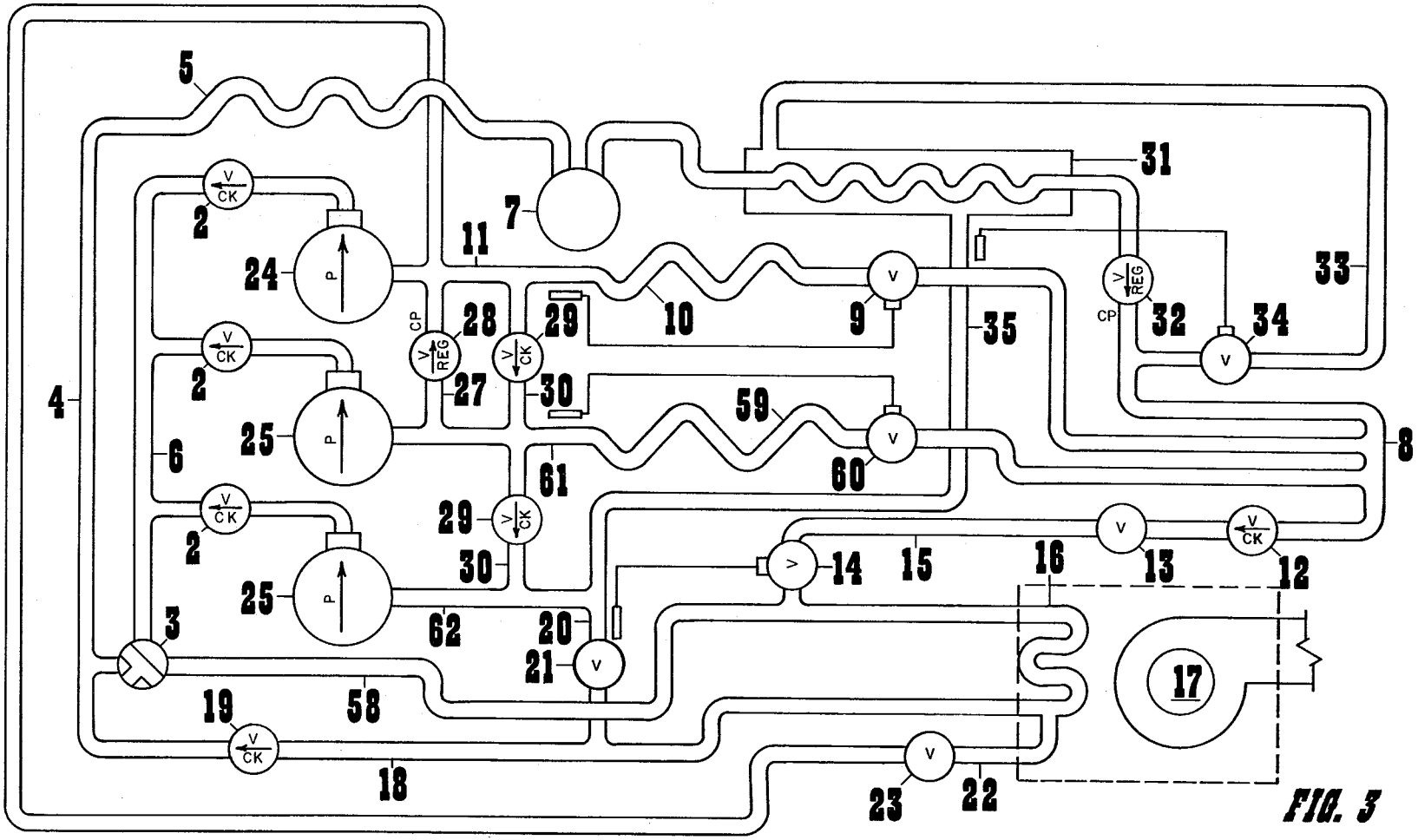
FIG. 3 is a schematic representation of a parallel compressor refrigeration system having a low temperature compressor circuit, a medium temperature compressor circuit and an air conditioning compressor for use with the combination coil and a subcooler.

FIG. 3, a representational schematic, discloses a typical parallel compressor refrigeration system for use in a small grocery market or convenience store. The parallel refrigeration system utilizes three compressors. Compressor 24 is the low temperature compressor which draws its suction from the low temperature evaporator 10 which is controlled by low temperature evaporator thermal expansion valve 9. Low temperature evaporators are typically used in freezer and meat display cases. The medium temperature compressor 25 draws its supply from the medium temperature evaporator 59 which is controlled by medium temperature thermal expansion valve 60. Medium temperature evaporators are normally used for dairy and beverage cases.

A high temperature compressor 26 is also provided for service with subcooler 31 and the combination heat reclaim and air conditioning coil 16.

Low temperature compressor 24 and medium temperature compressor 25 are cross connected by means of load transfer cross connect 27 and constant pressure relief valve 28. Constant pressure relief valve 28 monitors the suction pressure in low temperature compressor suction header 11 and will transfer low pressure refrigerant gas from the medium temperature compressor suction header 61 to low temperature compressor suction header 11 to maintain an optimum load on low temperature compressor 24.

Compressor overload cross connects 29 with compressor cross connect check valves 30 are provided between the three compressors to prevent overload on low temperature compressor 24 and medium temperature compressor 25.

Now referring to FIG. 2, when thermostat 57 calls for heat within the building, terminal 47 is energized, energizing coil 48 of heat reclaim relay 41 thus closing heat reclaim solenoid valve contactor 49 and opening purge valve contactor 50'. Indicator light 38 is provided.

Now referring to both FIGS. 2 and 3, with the control system of FIG. 2 calling for heat reclaim heat, reclaim valve 3 is energized to position itself so that the hot compressed gas refrigerant in the compressor discharge header 6 flows through heat reclaim discharge header 58 to the combination heat reclaim and air conditioning coil 16. Simultaneously, contact 44 of thermostat 57 is not energized, and air conditioning solenoid contactor 46 of air conditioning relay 40 remains open, thereby de-energizing the normally closed solenoid operated air conditioning supply line valve 13 and air conditioning compressor suction valve 21. With the heat reclaim valve 3 thus in the heat reclaim position, the combination heat reclaim and air conditioning coil 16 is placed in series with outside condenser 5 and isolated from the air conditioning system.

With purge valve contactor 50' in the open position purge valve 23 is also de-energized and closed and the combination heat reclaim and air conditioning coil serves as an inside condenser with fan 17 moving air through the coil system.

The partially condensed hot gas refrigerant from the heat reclaim and air conditioning coil 16 is further condensed in the outside condenser 5 and transported to the liquid receiver 7. From the liquid receiver 7 the condensed high pressure refrigerant is passed through subcooler 31 to the evaporator supply header 8. Subcooler 31 is supplied with refrigerant from evaporator supply header 8 through subcooler supply line 33 and controlled by subcooler thermal expansion valve 34. The hot gas discharge from subcooler 31 is ported through subcooler discharge header 35 to the high temperature compressor suction header 62.

If additional heat is required thermostat 57 energizes auxiliary heat contact 51 which in turn operates auxiliary heat relay coil 52 of delay timer 42, thus closing delay timer relay contactor 53. With delay timer relay contactor 53 closed auxiliary heat contactor coil 54 operates to close auxiliary heat contactors 55, thus energizing the auxiliary electric heaters. In practice it has been found that delay timer 42 should be set for a 30 minute delay to maximize the use of reclaimed heat and eliminate unnecessary cycling of the auxiliary heaters.

When thermostat 57 calls for air conditioning contact 44 is energized thus energizing the air conditioning relay coil 45 of the air conditioning relay 40 thus closing air conditioning solenoid valves contractor 46 and opening purge valve contactor 50. Indicator light 37 is provided.

In this configuration the air conditioning liquid line supply valve 13 and the air conditioning compressor suction valve 21, as shown on FIG. 3, are energized to open and heat reclaim valve 3 positioned to direct flow directly from compressor discharge header 6 to condenser supply line 4. When valves 13 and 21 are open, liquid refrigerant from the evaporator supply header 8 flows through the air conditioning liquid line supply header 15 to supply liquid refrigerant to the air conditioning thermal expansion valve 14 which controls the combination heat reclaim and air conditioning coil 16. The discharge from the combination heat reclaim and air conditioning coil 16 is then drawn into the high temperature compressor suction header 62 through the air conditioning compressor suction line 20. The discharge from the combination heat reclaim and air conditioning coil 16 will not pass through the heat reclaim discharge header 18 to the condenser supply line 4 because of the higher pressure in the condenser supply line 4 which keeps the heat reclaim discharge header check valve 19 in a shut position.

Purge line 22 is supplied to drain the combination heat reclaim and air conditioning coil 16 to the low temperature suction header 11 when the combination coil 16 is not in use for either heat reclaiming or air conditioning. This prevents any condensed liquid refrigerant from being inadvertently passed through the air conditioning discharge header 20 to the high temperature compressor suction header 62 and into the high temperature compressor 26 where it might possible do some damage.

Control of the purge line is accomplished through the use of solenoid operated purge valve 23 and purge valve contactors 50 and 50'. Solenoid operated purge valve 23 is normally closed and only energizes to open when the system is calling for neither heat reclaim or air conditioning. This is achieved through contactors 50 and 50' which will open, thus de-energizing and closing purge valve 23, whenever the heat reclaim relay 41 or air conditioning relay 40 are energized.

Additional protection is afforded by use of pressure switch 43, as shown in FIG. 2. If the purge system were to fail after use of the combination coil for heat reclaiming, liquid condensate could be drawn into the high temperature compressor 26. To prevent this, pressure switch 43 is installed to detect pressures greater than atmospheric in the combination coil 16.

Pressure switch 43 opens to prevent energization of air conditioning relay 40 when pressure in the coil 16 exceeds a predetermined set point. In this manner, use of coil 16 is prevented unless and until the purge system has operated properly and has had sufficient time to drain liquid condensate from the coil 16.

Having thus described in detail preferred designs which embody the concepts and principals of the invention and which accomplish the various objects, purposes and names thereof, it is to be appreciated and will be apparent to those skilled in the art that many physical changes could be made in this invention without altering the inventive concepts or principals embodied therein. Hence, it is intended that the scope of this invention be limited only to the extent indicated in the appended claims.

What I claim is:

1. In a refrigeration system having:

compressor means having a suction and a discharge, a compressor discharge header connected to the discharge the compressor means, first condensing means, a condenser supply line operatively connecting said compressor discharge header to said first consenser means, evaporator means, evaporator supply means for operatively connecting said first condenser means to the evaporator means, compressor suction header connecting the evaporator means to the suction of the compressor means for receiving the discharge of the evaporator means, a combined heat reclaim and air conditioning coil comprising:

(a) a coil, having an inlet and an outlet, for condensing refrigerant gas or evaporating low pressure refrigerant liquid; and (b) coil supply means for selectively connecting the inlet of the coil to either the compressor discharge header or to the evaporator supply means; and (c) coil discharge means for operatively connecting the outlet of the coil to the condenser supply line when the coil supply means is operatively connected to the compressor discharge header or operatively connecting the outlet of the coil to the compressor suction header when the coil supply means is operatively connected to the evaporator supply means; and (d) control means for selectively directing the flow of compressed refrigerant gas from the compressor discharge header to the coil supply means when the coil is to be used for condensing refrigerant gas or for selectively directing the flow of low pressure refrigerant liquid from the evaporator supply means to the coil supply means when the coil is to be used for evaporating low pressure refrigerant.

2. The apparatus of claim 1 wherein said coil supply means for selectively connecting the inlet of the coil to either the compressor discharge header or to the evaporator supply further comprises:

(a) a heat reclaim supply header for connecting the compressor discharge header to the inlet of the coil; and (b) a three way valve disposed between the compressor discharge header and the condenser supply line and the heat reclaim supply header for selectively directing and compressed refrigerant gas from the compressor discharge header to the condenser supply line or the heat reclaim supply header; and (c) an air conditioning liquid line supply header connecting the evaporator supply means to the inlet of the coil; and (d) an air conditioning liquid line supply shutoff valve disposed within said air conditioning liquid line supply header for selectively stopping flow of compressed condensed liquid refrigerant from the evaporator supply means to the inlet of the coil.

3. The apparatus of claim 2 wherein said air conditioning liquid line supply shutoff valve for selectively stopping flow of compressed condensed refrigerant further comprises:

(a) solenoid operated shutoff valve; and (b) means for selectively operating said solenoid valve.

4. The apparatus of claim 2 wherein said three way valve comprises:

(a) a solenoid operated valve; and (b) means for selectively operating said solenoid valve.

5. The apparatus of claim 1 wherein said coil discharge means for operatively connecting the outlet of the coil to the condenser supply line when the coil supply means is operatively connected to the compressor discharge header or operatively connecting the outlet of the coil to the compressor suction header when the coil supply means is operatively connected to the evaporator supply means further comprises:

(a) a heat reclaim discharge header connecting the outlet of the coil to the condenser supply line; and (b) a check valve disposed within said heat reclaim discharge header for prohibiting flow of compressed refrigerant gas from the condenser supply line to the outlet of the coil; and (c) an air conditioning compressor suction line connecting the outlet of the coil to the compressor suction header; and (d) an air conditioning compressor suction valve disposed within said air conditioning compressor suction line for allowing the flow of low pressure refrigerant gas from the outlet of the coil to the compressor suction header when the coil supply means is operatively connected to the evaporator supply means.

6. The apparatus of claim 1 wherein said combined heat reclaim and air conditioning coil further comprises:

(a) a purge line for draining condensed refrigerant from said coil after use as a condensing coil and before use as an evaporator coil; and (b) means for selectively opening and closing said purge line.

7. The apparatus of claim 6 wherein said means for selectively opening and closing said purge line comprises:

(a) a solenoid operated shut off valve disposed within said purge line for selectively permitting flow of refrigerant through said purge line; and (b) means for selectively operating said solenoid valve.

8. The apparatus of claim 7 wherein said solenoid operated valve is opened when said solenoid is energized and wherein said means for selectively operating said solenoid comprises:

(a) means for applying a voltage potential to said solenoid for energizing said solenoid; and (b) means for interrupting the application of said voltage potential to said solenoid when said coil is being used for either heat reclaiming or air conditioning.

9. In a refrigeration system having:

compressor means having a suction and a discharge, a compressor discharge header connected to the discharge of the compressor means, first condensing means, a condenser supply line operatively connecting said compressor discharge header to the first condenser means, evaporator means, evaporator supply means for operatively connecting said first condenser means to the evaporator means, a compressor suction header connecting the evaporator means to the suction of the compressor means for receiving the discharge of the evaporator means, a combined heat reclaim and air conditioning coil comprising:

(a) a coil, having an inlet and an outlet, for condensing compressed refrigerant gas or evaporating low pressure refrigerant liquid; and (b) a heat reclaim supply header operatively connecting the compressor discharge header to the inlet of the coil; and (c) a three way valeve disposed between the compressor discharge header and the condenser supply line and the heat reclaim supply header for selectively directing the flow of compressed refrigerant gas from the compressor discharge header to either the condenser supply line or the heat reclaim supply header when the coil is to be used for condensing compressed refrigerant gas; and (d) an air conditioning liquid line supply header operatively connecting the evaporator supply means to the inlet of the coil; and (e) an air conditioning liquid line supply shutoff valve disposed within said air conditioning liquid line supply header for selectively allowing flow of compressed condensed refrigerant from the evaporator supply means to the inlet of the coil when the coil is to be used for evaporating low pressure refrigerant liquid; and (f) a heat reclaim discharge header operatively connecting the outlet of the coil to the condenser supply line at a point downstream of the three way valve; and (g) a check valve disposed within said heat reclaim discharge header for prohibiting backflow of compressed refrigerant gas from the consenser supply line to the outlet of the coil; and (h) an air conditioning compressor suction line operatively connecting the outlet of the coil to the compressor suction header; and (i) an air conditioning compressor suction valve disposed within said air conditioning compressor suction line for selectively allowing the flow of low pressure refrigerant gas from the outlet of the coil to the compressor suction header when the coil is to be used for evaporating low pressure refrigerant liquid.

10. In a parallel refrigeration system having:

a compressor discharge header, first compressor means operatively connected to said compressor discharge header, second compressor means operating at a suction pressure greater than that of said first compressor means connected to said compressor discharge header, first condenser means, a condensor supply line operatively connecting said compressor discharge header to said first condenser means, first evaporator means, second evaporator means for operation at a greater pressure than that of said first evaporator means, evaporator supply means for operatively connecting said first condenser means to the first evaporator means and to the second evaporator means, a first compressor suction header connected to the suction of the first compressor means for receiving the disclosure of the first evaporator means, a second compressor suction header connected to the suction of the second compressor means for receiving the gas effulent of the second evaporator means, a combined heat reclaim and air conditioning coil comprising:

(a) a coil, having an inlet and an outlet, for condensing compressed refrigerant gas or evaporating low pressure refrigerant liquid; and (b) means for selectively operatively connecting said coil to the compressor discharge header in either serial relationship with the first condenser means or to the evaporator supply header in parallel relationship with the second evaporator means.

11. The apparatus of claim 10 wherein said means for selectively operatively connecting said coil to the compressor discharge header either in serial relationship with the first condenser means or to the evaporator supply means in parallel relationship with the second evaporator means further comprises:

(a) coil supply means for selectively connecting the inlet of the coil to either the compressor discharge header or to the evaporator supply means; and (b) coil discharge means for operatively connecting the outlet of the coil to the condenser supply line when the coil supply means is operatively connected to the compressor discharge header or operatively connecting the outlet of the coil to the second compressor suction header when the coil supply means is operatively connected to the evaporator supply means; and (c) means for selectively directing the flow of compressed refrigerant gas from the compressor discharge header to the coil supply means when the coil is to be used for condensing refrigerant gas or for selectively directing the flow of low pressure refrigerant liquid from the evaporator supply means to the coil supply means when the coil is to be used for evaporating low pressure refrigerant.

12. The apparatus of claim 11 wherein said coil supply means for selectively connecting the inlet of the coil to either the compressor discharge header or to the evaporator supply means further comprises:

(a) a heat reclaim supply header for connecting the compressor discharge header to the inlet of the coil; and (b) a three way valve disposed between the compressor discharge header and the condenser supply line and the heat reclaim supply header for selectively directing the compressed refrigerant gas from the compressor discharge header to the condenser supply line or the heat reclaim supply header; and (c) an air conditioning liquid line supply header connecting the evaporator supply means to the inlet of the coil; and (d) an air conditioning liquid line supply shutoff valve disposed within said air conditioning liquid line supply header for selectively stopping flow of compressed condensed liquie refrigerant from the evaporator supply means to the inlet of the coil.

13. The apparatus of claim 12 wherein said air conditioning liquid supply shutoff valve for selectively stopping flow of compressed condensed refrigerant further comprises:

(a) solenoid operated shutoff valve; and (b) means for selectively operating said solenoid valve.

14. The apparatus of claim 13 wherein said three way valve comprises:

(a) a solenoid operated valve; and (b) means for selectively operating said solenoid valve.

15. The apparatus of claim 11 wherein said coil discharge means for operatively connecting the outlet of the coil to the condenser supply line when the coil supply means is operatively connected to the compressor discharge header or operatively connecting the outlet of the coil to the second compressor suction header when the coil supply means is operatively operated to the evaporator supply means further comprises:

(a) a heat reclaim discharge header connecting the outlet of the coil to the condenser supply line; and (b) a check valve disposed within said heat reclaim discharge header for prohibiting flow of compressed refrigerant gas from the condenser supply line to the outlet of the coil; and (c) an air conditioning compressor suction line connecting the outlet of the coil to the second compressor suction header; and (d) an air conditioning compressor suction valve disposed within said air conditioning compressor suction line for allowing the flow of low pressure refrigerant gas from the outlet of the coil to the second compressor suction header when the coil supply means is operatively connected to the evaporator supply means.

16. The apparatus of claim 11 wherein said combined heat reclaim and air conditioning coil further comprises:

(a) a purge line for draining condensed refrigerant from said coil after use as a condensing coil and before use as an evaporator coil; and (b) means for selectively opening and closing said purge line.

17. The apparatus of claim 16 wherein said means for selectively opening and closing said purge line comprises:

(a) a solenoid operated shut off valve disposed within said purge line for selectively permitting or prohibiting flow of condensed liquid refrigerant through said purge line; and (b) means for selectively operating said solenoid valve.

18. The apparatus of claim 17 wherein said solenoid operated valve is opened when said solenoid is energized and wherein said means for selectively operating said solenoid comprises:

(a) means for applying a voltage potential to said solenoid for energizing said solenoid; and (b) means for interrupting the application of said voltage potential to said solenoid when said coil is being used for either heat reclaiming or air conditioning.

19. In a parallel refrigeration system having:

a compressor discharge header, first compressor means operatively connected to said compressor discharge header, second compressor means operating at a suction pressure greater than that of said first compressor means connected to said compressor discharge header, first condenser means, a condenser supply line operatively connecting said compressor discharge header to said first condenser means, first evaporator means, second evaporator means for operation at a greater pressure than that of said first evaporator means, an evaporator supply means for operatively connecting said first condenser means to the first evaporator means and to the second evaporator means, a first compressor suction header connected to the suction of the first compressor means for receiving the gas effulent of the first evaporator means, a second compressor suction header connected to the suction of the second compressor means for receiving the gas effulent of the second evaporator means, a combined heat reclaim and air conditioning coil comprising:

(a) a coil, having an inlet and an outlet, for condensing compressed refrigerant gas or evaporating low pressure refrigerant liquid; and (b) a heat reclaim supply header operatively connecting the compressor discharge header to the inlet of the coil; and (c) a three way valve disposed between the compressor discharge header and the condenser supply line and the heat reclaim supply header for selectively directing the flow of compressed refrigerant gas from the compressor discharge header to either the condenser supply line or the heat reclaim supply header when the coil is to be used for condensing compressed refrigerant gas; and (d) an air conditioning liquid line supply header operatively connecting the evaporator supply means to the inlet of the coil; and (e) a air conditioning liquid line supply shutoff valve disposed within said air conditioning liquid line supply header for selectively allowing flow of compressed condensed refrigerant from the evaporator supply means to the inlet of the coil when the coil is to be used for evaporating low pressure refrigerant liquid; and (f) a heat reclaim discharge header operatively connecting the outlet of the coil to the condenser supply line at a point down stream of the three way valve; and (g) a check valve disposed within said heat reclaim discharge header for prohibiting back flow of compressed refrigerant gas from the condenser supply line to the outlet of the coil; and (h) an air conditioning compressor suction line operatively connecting the outlet of the coil to the second compressor suction header; and (i) an air conditioning compressor suction valve disposed within said air conditioning compressor suction line header for selectively allowing the flow of low pressure refrigerant gas from the outlet of the coil to the second compressor suction header when the coil is to be used for evaporating low pressure refrigerant liquid.

20. A parallel refrigeration system comprising:

(a) a compressor discharge header; and (b) first compressor means operatively connected to said compressor discharge header; and (c) first condenser means; and (d) a condenser supply line operatively connecting said compressor discharge header to said first condenser means; and (e) first evaporator means; and (f) evaporator supply means for operatively connecting said first condenser means to the first evaporator means; and (g) a first compressor suction header connected to the suction of the first compressor means for receiving the discharge of the first evaporator means; and (h) air conditioner compressor means operatively connected to the compressor discharge header; and (i) a coil, having an inlet and an outlet, for condensing compressed refrigerant gas or evaporating low pressure refrigerant liquid; and (j) a heat reclaim supply header operatively connecting the compressor discharge header to the inlet of the coil; and (k) a three way valve disposed between the compressor discharge header and the condenser supply line and the heat reclaim supply header for selectively directing the flow of compressed refrigerant gas from the compressor discharge header to either the condenser supply line or the heat reclaim supply header when the coil is to be used for condensing compressed refrigerant gas; and (l) an air conditioning liquid line supply header operatively connecting the evaporator supply means to the inlet of the coil; and (m) an air conditioning liquid line supply shutoff valve disposed within said air conditioning liquid line supply header for selectively allowing flow of compressed condensed refrigerant from the evaporator supply means to the inlet of the coil when the coil is to be used for evaporating low pressure refrigerant liquid; and (n) a heat reclaim discharge header operatively connecting the outlet of the coil to the condenser supply line at a point down stream of the three way valve; and (o) a check valve disposed within said heat reclaim discharge header for prohibiting back flow of compressed refrigerant gas from the condenser supply line to the outlet of the coil; and (p) an air conditioning compressor suction line operatively connecting the outlet of the coil to the suction of the air conditioning compressor means; and (q) an air conditioning compressor suction valve disposed within said air conditioning discharge header for selectively allowing the flow of low pressure refrigerant gas from the outlet of the coil to the suction of the air conditioning compressor when the coil is to be used for evaporating low pressure refrigerant liquid.

21. The apparatus of claim 20 wherein said system further comprises:

(a) a purge line for draining condensed refrigerant from said coil after use as a condensing coil and before use as an evaporator coil; and (b) means for selectively opening and closing said purge line.

22. The apparatus of claim 21 wherein said means for selectively opening and closing said purge line comprises:

(a) a solenoid operated shut off valve disposed within said purge line for selectively permitting flow of refrigerant through said purge line; and (b) means for selectively operating said solenoid valve.

* * * * *